US010926125B1

(12) United States Patent
Candler

(10) Patent No.: US 10,926,125 B1
(45) Date of Patent: Feb. 23, 2021

(54) SELF-SPOTTING BENCH PRESS

(71) Applicant: Kevin M. Candler, Osceola, IN (US)

(72) Inventor: Kevin M. Candler, Osceola, IN (US)

( * ) Notice: Subject to any disclaimer, the term of this patent is extended or adjusted under 35 U.S.C. 154(b) by 15 days.

(21) Appl. No.: 16/240,903

(22) Filed: Jan. 7, 2019

(51) Int. Cl.

| | |
|---|---|
| ***A63B 21/078*** | (2006.01) |
| ***A63B 21/072*** | (2006.01) |
| ***A63B 21/08*** | (2006.01) |
| ***A63B 21/00*** | (2006.01) |
| ***A63B 21/062*** | (2006.01) |
| ***A63B 23/12*** | (2006.01) |
| ***A63B 23/035*** | (2006.01) |

(52) U.S. Cl.
CPC ..... *A63B 21/0783* (2015.10); *A63B 21/0626* (2015.10); *A63B 21/0724* (2013.01); *A63B 21/08* (2013.01); *A63B 21/154* (2013.01); *A63B 21/4029* (2015.10); *A63B 21/4034* (2015.10); *A63B 23/03591* (2013.01); *A63B 23/1209* (2013.01)

(58) Field of Classification Search
CPC ..... A63B 21/0783; A63B 21/0626; A63B 21/4029; A63B 21/4034; A63B 21/0724; A63B 21/08; A63B 21/078; A63B 21/4031; A63B 21/155; A63B 23/03591
USPC ..... 842/1
See application file for complete search history.

(56) References Cited

U.S. PATENT DOCUMENTS

| | | | | |
|---|---|---|---|---|
| 4,907,798 | A * | 3/1990 | Burchatz | A63B 21/06 482/104 |
| 5,310,394 | A * | 5/1994 | Kallios | A63B 21/00181 482/104 |
| 2005/0272577 | A1* | 12/2005 | Olson | A63B 21/00072 482/123 |
| 2005/0277524 | A1* | 12/2005 | Bae | A63B 21/078 482/93 |
| 2006/0148624 | A1* | 7/2006 | Bae | A63B 21/0783 482/93 |
| 2006/0183607 | A1* | 8/2006 | Collias | A63B 21/078 482/94 |
| 2008/0004165 | A1* | 1/2008 | Brawner | A63B 21/4029 482/104 |
| 2011/0263395 | A1* | 10/2011 | Breaux | A63B 21/078 482/94 |
| 2013/0184128 | A1* | 7/2013 | Towley, III | A63B 21/156 482/102 |
| 2013/0190143 | A1* | 7/2013 | Greenhill | A63B 21/0058 482/104 |

* cited by examiner

*Primary Examiner* — Andrew S Lo
*Assistant Examiner* — Thao N Do
(74) *Attorney, Agent, or Firm* — Krieg DeVault LLP; Daniel Tychonievich

(57) ABSTRACT

A system and mechanism for a self-spotting bench press, and in particular, to a mechanism wherein a user that is bench pressing free weights can utilize to assist in lifting weights back on the bench's weight stand, without the aid of a spotter.

15 Claims, 11 Drawing Sheets

SELF-SPOTTING BENCH PRESS

BACKGROUND OF THE INVENTION

The subject invention relates to a system and mechanism for a self-spotting bench press, and in particular, to a mechanism wherein a user that is bench pressing free weights can utilize to assist in lifting weights back on the bench's weight stand, without the aid of a spotter.

Weight benches are well known and popular for use in weight conditioning and in sport of weight lifting. There are many varieties of weight lifting benches from simple flat benches to benches that include additional features, such as an incline for varying the angle in which a user is supported on the bench or leg lifts for extending and exercising a user's legs. The basic parts of a weight bench are common, though. In particular, the weight bench typically includes a plurality of legs for supporting a horizontal bench in which a user may recline on his back while keeping his lower legs and feet on opposite sides of the bench with feet firmly planted on the ground. Weight benches also include a weight stand, which typically consists of two vertical poles on opposite sides of the bench. At the top of the poles are typically Y shaped members which can hold and support a weight bar and weights with the weight bar resting in the crotch of the Y members.

When bench pressing heavy weights, performing multiple repetitions or when lifting to failure (fatiguing the muscles to a point when you cannot do any additional repetitions), it is required for safety to have a spotter. A spotter is a person standing behind the bench to assist lifting the weights back onto the support on the bench so that the lifter is not injured by having the weights fall on him/her or from not being able to lift the weights up off their person. This can be a significant disadvantage as a lifter is limited in the workout he/she can do if working out alone.

The subject invention overcomes these shortfalls, as a mechanism is provided that enables a person to work out and safely lift weights on a bench press without the need for a spotter. In one embodiment, the invention aids a user in lifting the weight bar through a cabled system of pulleys by using a foot pedal. The user pushes the foot pedal forward during the exercise and the motion reduces the weight put on the user's upper body from the weight, allowing the user to finish the rep. The claimed invention can be used in commercial, public or private gyms to provide a safer, more user friendly alternative to the traditional bench press.

SUMMARY OF THE INVENTION

In one embodiment of the invention, a self-spotting bench press mechanism and system is provided that includes a bottom support frame; an upright support attached to the bottom support frame and extending upward; an extension support arm attached to the upright support and configured to extend out over at least a portion of a weight bench located therebeneath; and a foot pedal hingeably connected to the bottom frame support. The self-spotting bench press mechanism and system also includes a cable configured to be connected to a barbell at one end thereof and connected to the foot pedal at the other end thereof; a plurality of pulleys, with at least one pully attached to the extension support arm and one to the upright support, the cable supported on the pulleys; and a tensioning mechanism to keep tension on the cable as the end of the cable configured to be connected to a barbell moves vertically up and down.

The self-spotting bench press mechanism and system may also include a third pulley attached to the extension support. The tensioning mechanism can include a weight suspended on the cable between the pulleys that are attached to the extension support arm. The foot pedal can be attached to a swing arm, and the cable can also be attached to the swing arm. The swing arm can be hingeably connected to the bottom support frame.

The self-spotting bench press mechanism and system can also include a cable guide attached to the bottom support frame. The cable guide can include a hole therethrough for receipt of the cable.

The self-spotting bench press mechanism and system can be configured so that when a user pushes on the foot pedal, the end of the cable configured to be connected to a barbell raises vertically upward.

In another embodiment of the invention, a self-spotting bench press mechanism and system is provided that includes a weight bench configured to support a user and a barbell with weights; a bottom support frame; an upright support attached the bottom support frame and extending upward; and an extension support arm attached to the upright support and configured to extend out over the barbell supported on the weight bench. The self-spotting bench press mechanism and system also includes a foot pedal hingeably connected to said bottom frame support; a cable configured to be connected to a barbell at one end there of and connected to the foot pedal at the other end thereof; a plurality of pulleys, with at least one pully attached to the extension support arm and one to the upright support, the cable supported on the pulleys; and a tensioning mechanism to keep tension on the cable as the end of the cable configured to be connected to a barbell moves vertically up and down.

The self-spotting bench press mechanism and system can also include a third pulley. The third pulley can be attached to the extension support arm, and the third pulley can also support the cable. The tensioning mechanism can include a weight suspended on the cable between the pulleys attached to the extension support arm.

The foot pedal can be attached to a swing arm, and the cable can also be attached to the swing arm. The swing arm can be hingeably connected to the bottom support frame. The self-spotting bench press mechanism and system can also include a leg leverage support configured to allow a user to gain leverage by pulling on the leverage support with one leg while using the other leg to push the foot pedal forward. The leverage support can be attached to the weight bench. The leverage support can extend above a surface of the weight bench configured to support the user.

In still a different embodiment of the invention, a self-spotting bench press mechanism and system is provided that includes a bottom support frame; an upright support attached the bottom support frame and extending upward; an extension support arm attached to the upright support and configured to extend out over at least a portion of a weight bench located therebeneath; and a foot pedal hingeably connected to the bottom frame support. The self-spotting bench press mechanism and system also includes a cable configured to be connected to a barbell at one end thereof and connected to the foot pedal at the other end thereof; a plurality of pulleys, with at least at least two pulleys attached to the extension support arm, the cable supported on the pulleys; and a tensioning mechanism to keep tension on the cable as the end of the cable configured to be connected to a barbell moves vertically up and down.

The tensioning mechanism can include a weight suspended on the cable between the pulleys attached to the extension support arm. The self-spotting bench press mechanism and system can also include a leg leverage support configured to allow a user to gain leverage by pulling on the leverage support with one leg while using the other leg to push the foot pedal forward. The leverage support can extend above a surface of the weight bench configured to support a user. The leverage support can be mounted at an angle to the vertical.

The self-spotting bench press mechanism and system can also be configured so that the cable includes more than one connection point where it is configured to be connected to a barbell.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
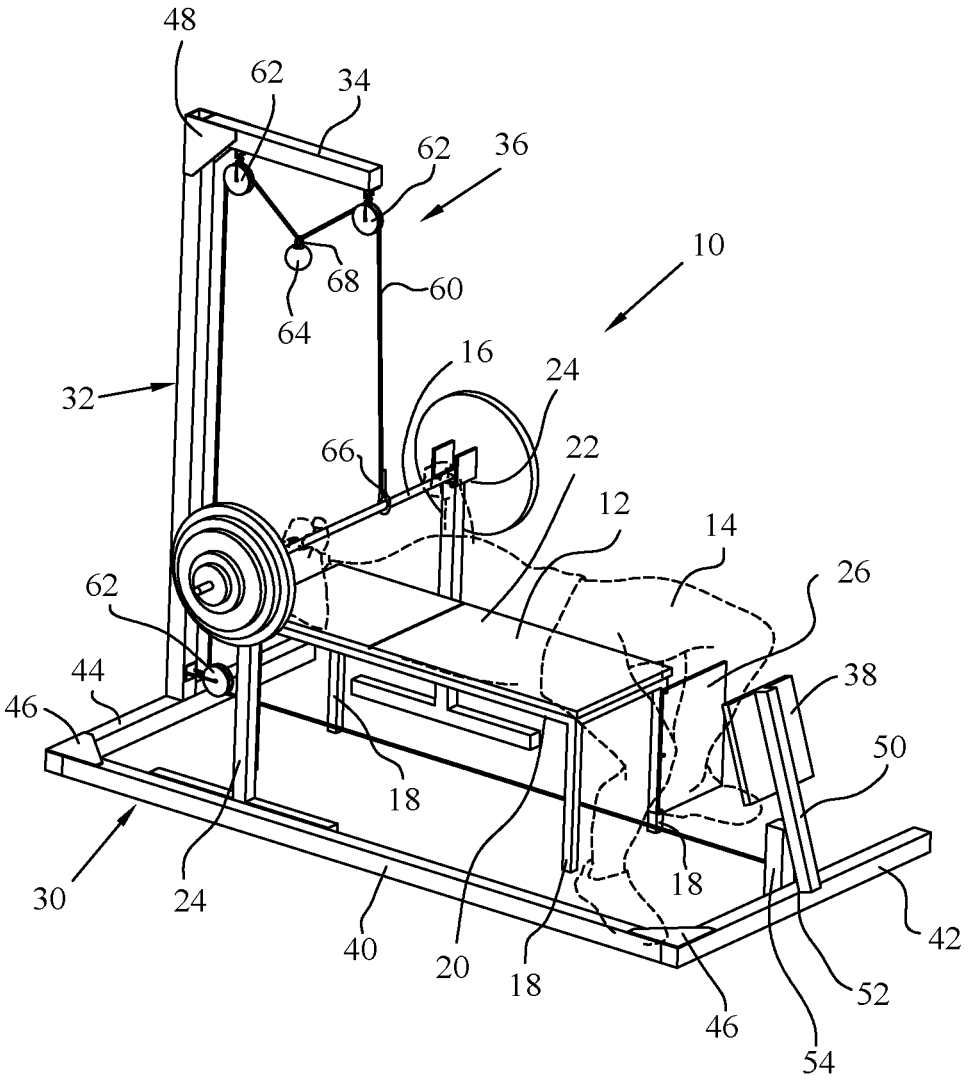
FIG. 1 is a perspective view of one embodiment of a self-spotting bench press in accordance with the subject invention shown with a bar bell being supported on a weight bench stand.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 1A:
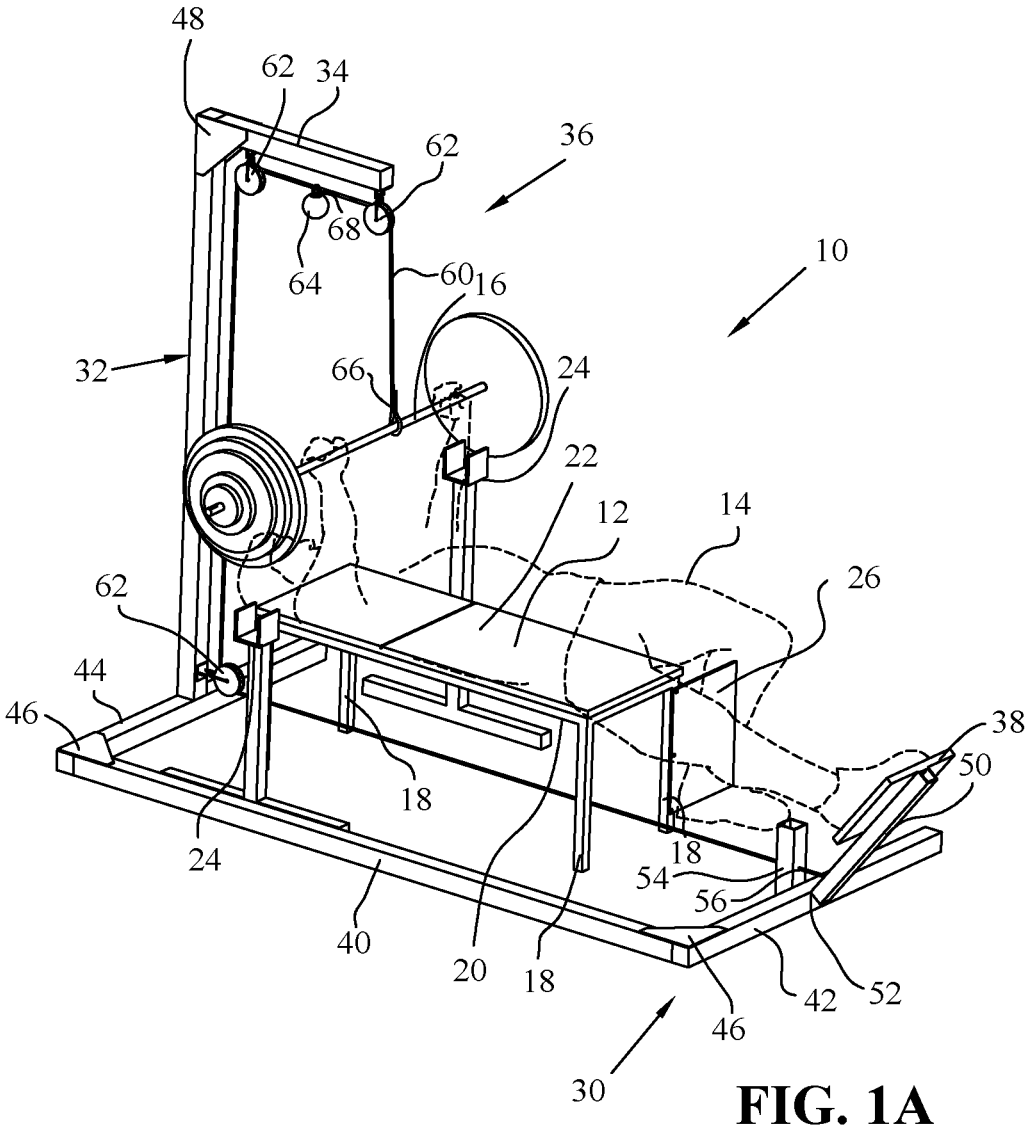
FIG. 1A is a perspective view of a self-spotting bench press of FIG. 1 shown with a user utilizing the self-spotting bench press to assist in lifting the bar bell.
Figure 2:
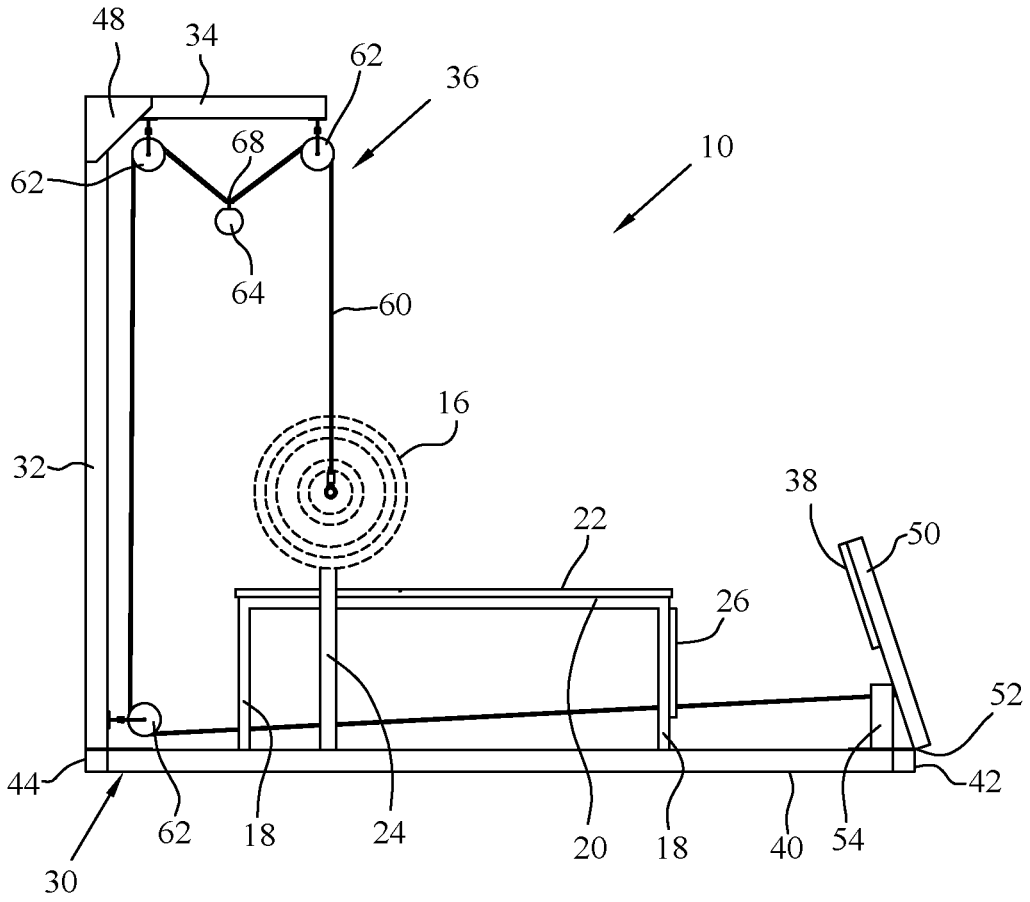
FIG. 2 is a side view of a self-spotting bench press of FIG. 1.
Figure 3:
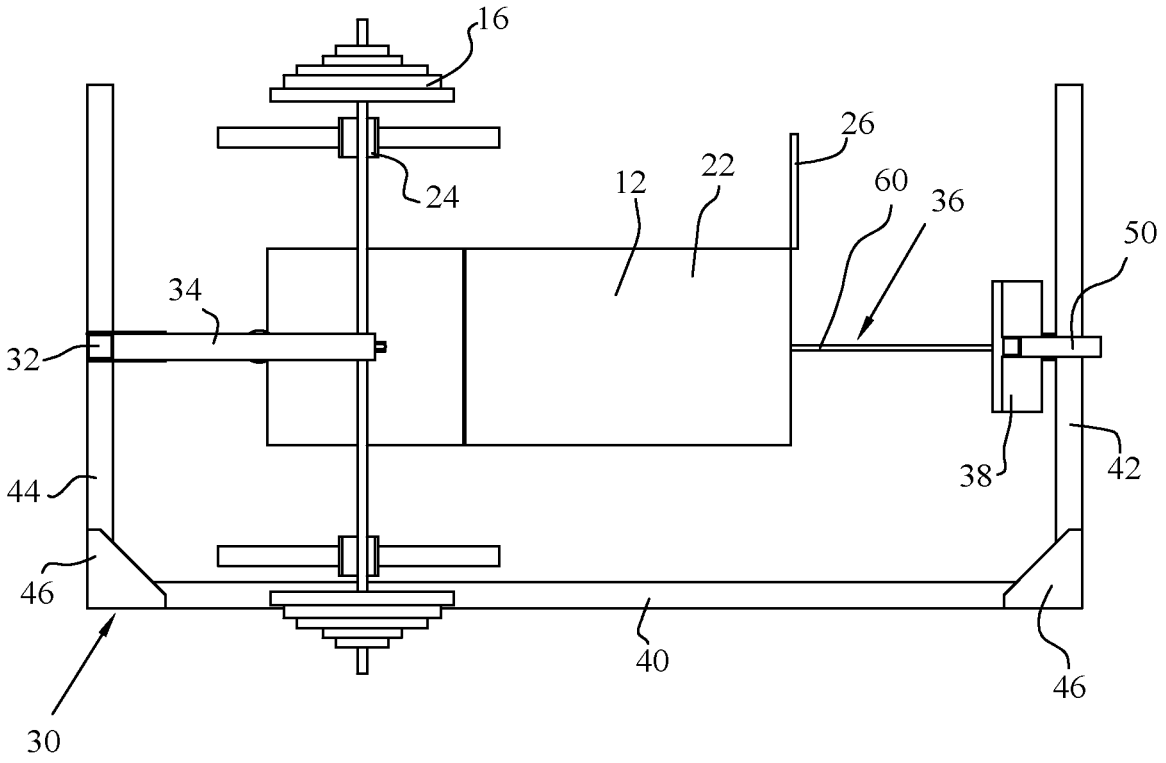
FIG. 3 is a top plan view of the self-spotting bench press of FIG. 1.
Figure 4:
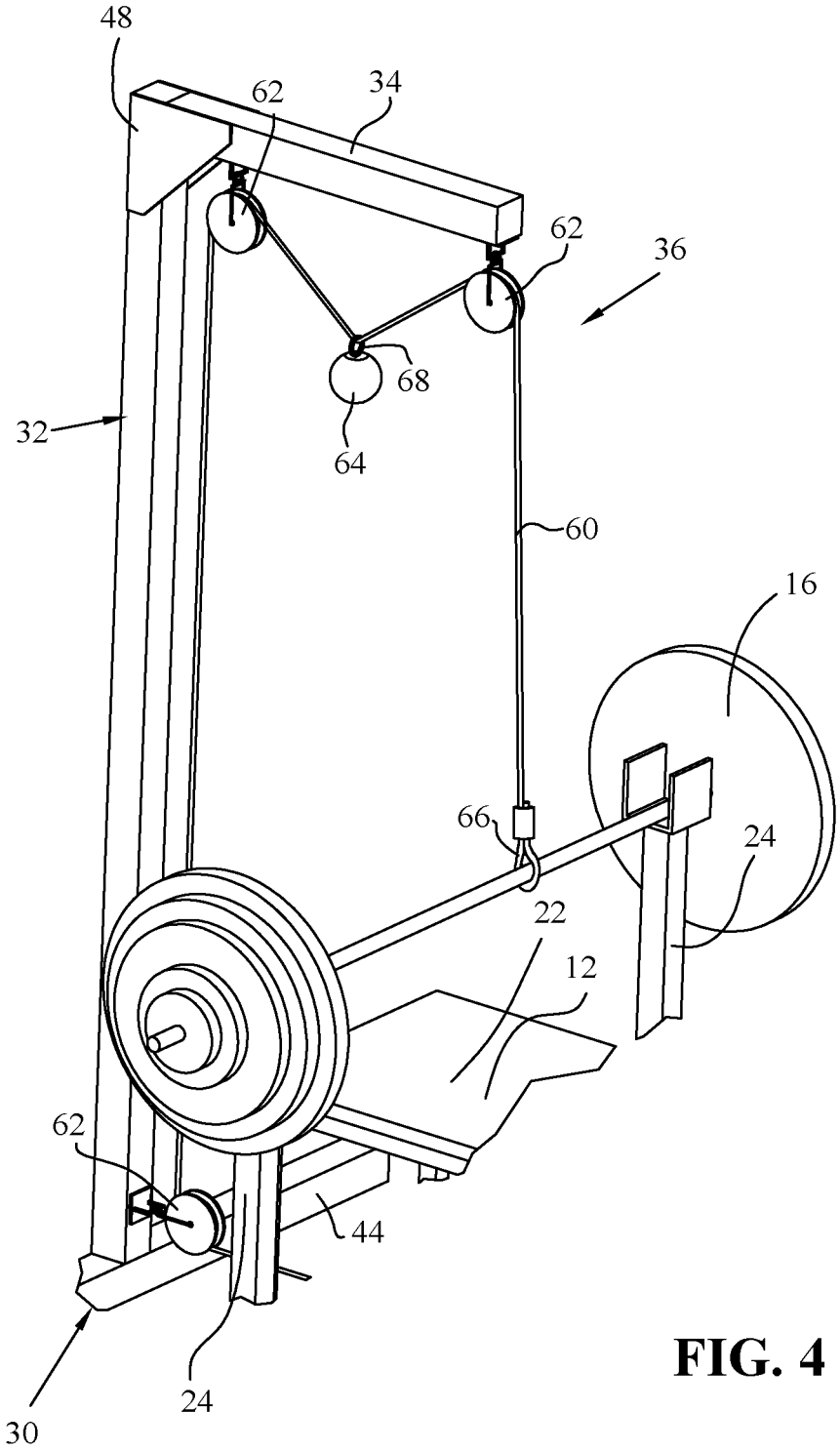
FIG. 4 is a perspective view of a pulley system on the self-spotting bench press of FIG. 1.
Figure 5:
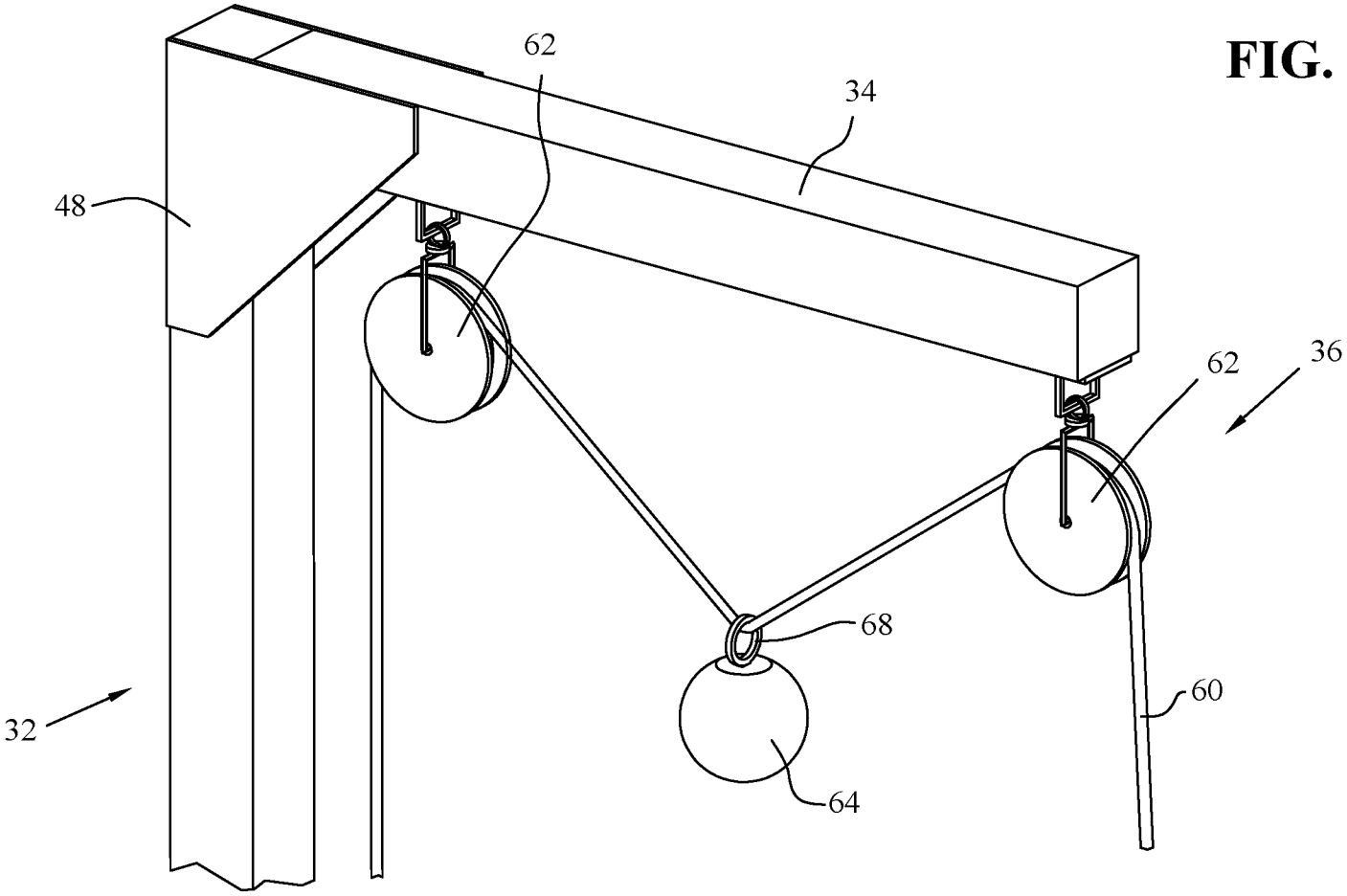
FIG. 5 is a large view of the pulley's in a slack cincher in the self-spotting bench press of FIG. 1.
Figure 6:
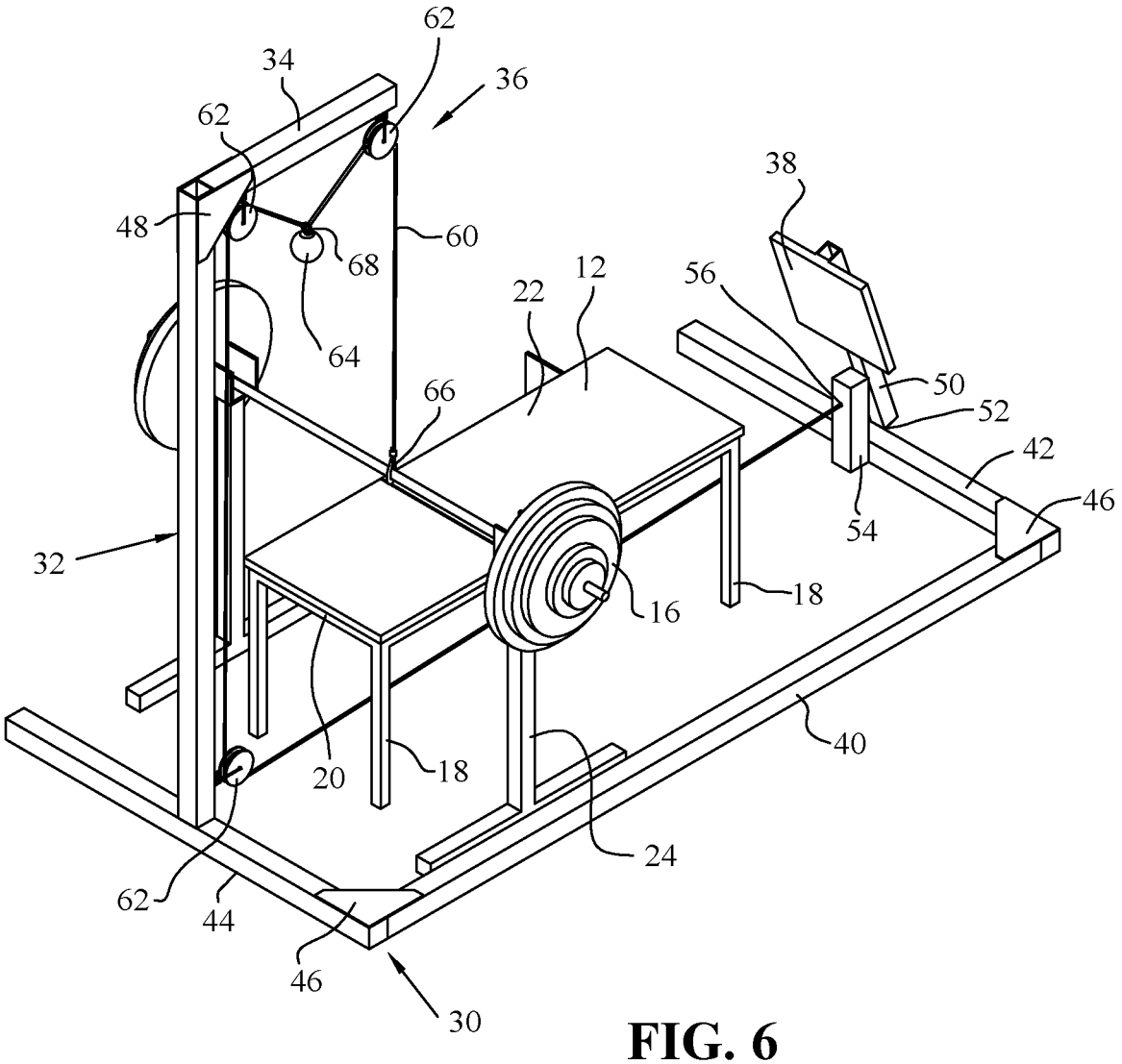
FIG. 6 is a rear perspective view of the self-spotting bench press of FIG. 1.
Figure 7:
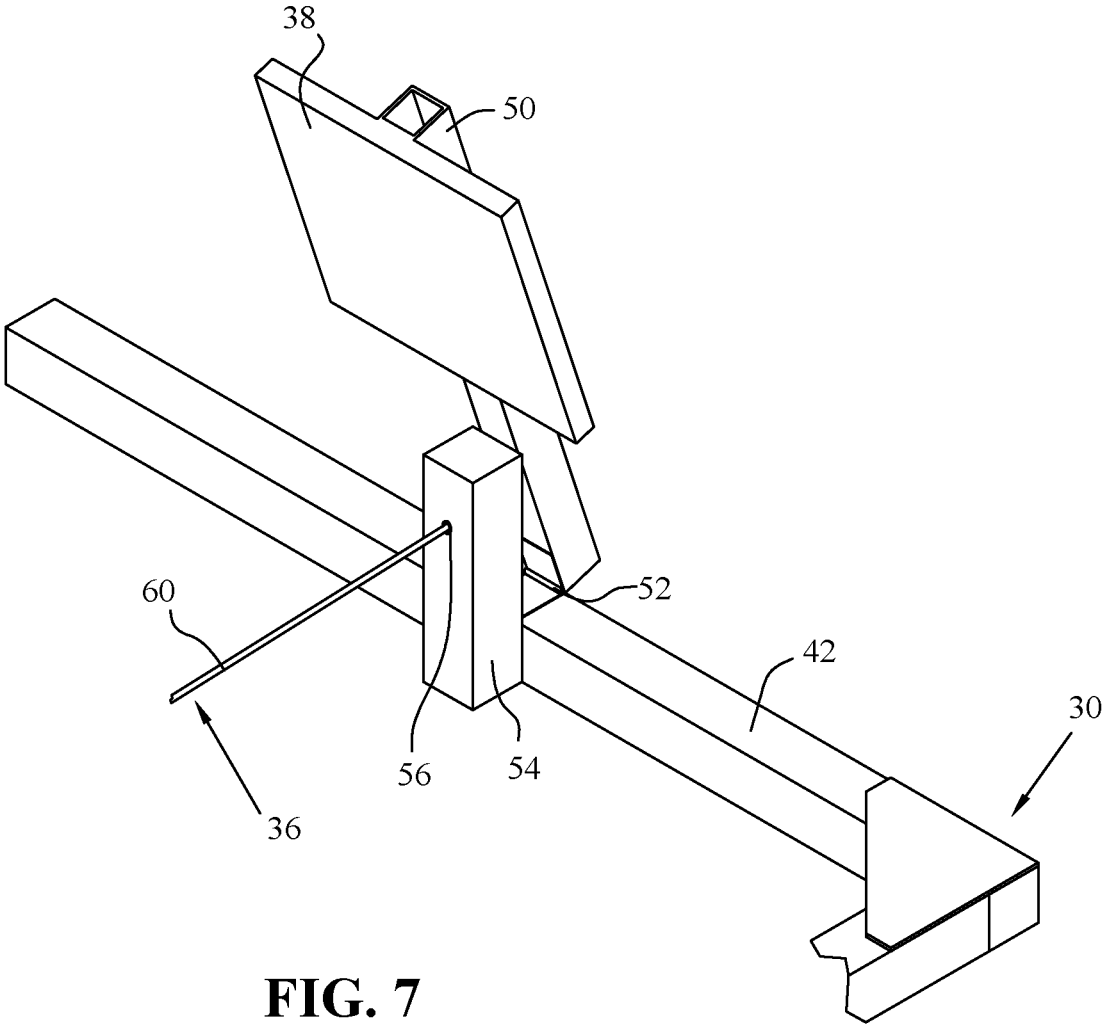
FIG. 7 is a perspective view of a foot control of the self-spotting bench press of FIG. 1.
Figure 8:
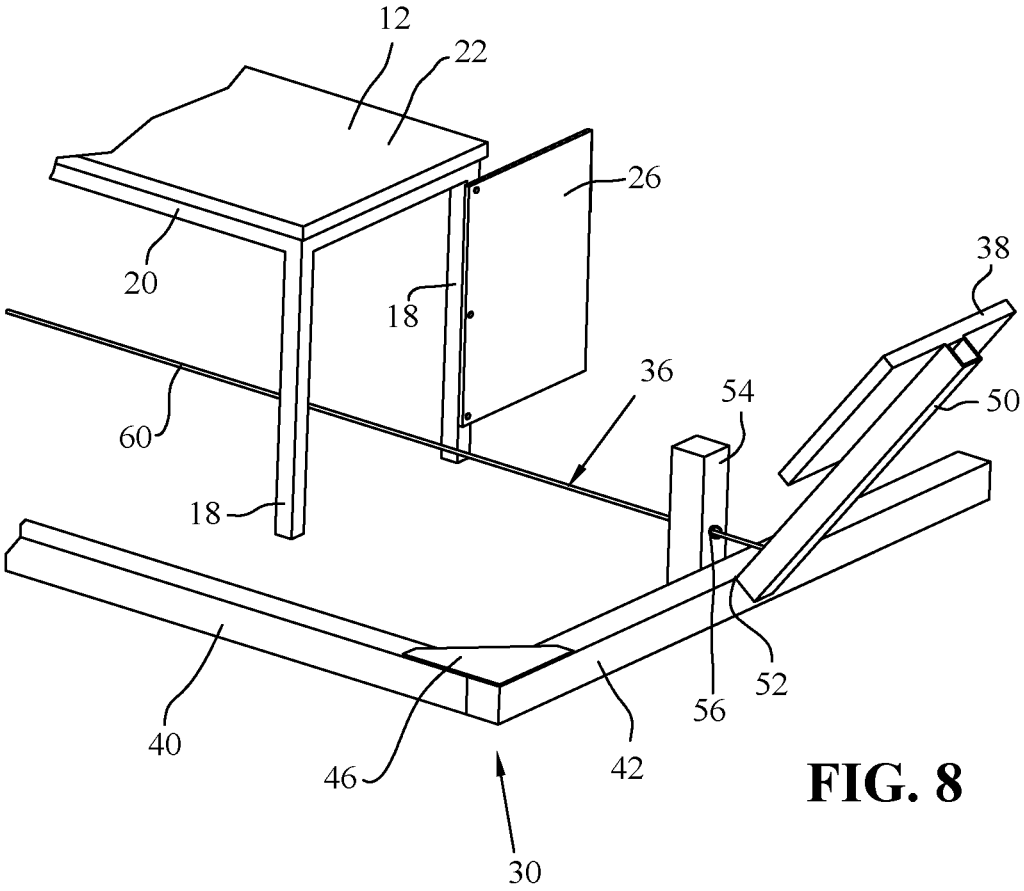
FIG. 8 is a perspective view of the foot pedal and a leg support on the self-spotting bench press of FIG. 1.

Referring now to FIGS. 1-8, one embodiment of a self-spotting bench press mechanism and system is shown generally indicted as 10. A standard bench 12 is shown, which can be used with self-spotting bench press mechanism and system 10 is, and a user or lifter 14 is shown in broken lines in FIGS. 1 and 1A, lying on bench 12 and lifting a barbell with weights 16. It should be appreciated that bench 12 and barbell and weights 16 are well known in the art and a variety of readily available units can be utilized with self-spotting bench press mechanism and system 10. Alternately, bench 12 may be provided as part of self-spotting bench press mechanism and system 10. In the embodiment shown, bench 12 includes four legs 18, a frame 20 supported by legs 18, 18*a*, a user support 22, and a pair of weight supports 24, located at an end of bench 12 where user 14's head is located when using bench 12. Bench 12 also includes a leg leverage support 26, which in the embodiment shown is attached to one of legs 18 using fasteners or other known means of attachment. The use of leg leverage support will be described in further detail below.

Self-spotting bench press mechanism and system 10 also includes a bottom support or frame, generally indicated as 30, an upright support, generally indicated as 32, an extension support arm 34, a pulley and cable system, generally indicated as 36, and a foot pedal 38. In the embodiment shown, bottom frame 30 has a generally C shaped configuration and is preferably manufactured from a suitably strong material, such as but not limited to, steel or aluminum as is also suitable for all of the structural members of self-spotting bench press mechanism and system 10. Bottom frame 30 includes a longitudinal member 40 and two cross members 42, 44. Members 40, 42, and 44 may be attached by welding or using suitable fasteners and can be made from circular or square tubing or angled members for instance, as is also suitable for all of the structural members of self-spotting bench press mechanism and system 10. Stiffeners 46 are attached in the joining areas of members 40, 42, and 44 to provided added strength and stability to the assembly.

Upright support 32 is attached to and extends upward and perpendicular from cross support member 44 and is attached using a suitable joining method such as by welding. Extension support arm 34 is attached to the opposite end of upright support 32 by welding or other suitable means and extends perpendicular thereto and parallel to longitudinal member 40. Stiffeners 48 can be used to enhance the rigidity and strength of this connection.

In the embodiment shown, foot pedal 38 is mounted to a swing arm 50 using fasteners or other suitable attachment means. Swing arm 50 is in turn, pivotally attached and connected to cross member 42 using a hinged connection 52. This allows the foot pedal to swing outward from bench 12 to reduce the effective weight of weights 16 as will be described in further detail below. Also, in the embodiment shown, a cable guide 54 is mounted to cross member 42 extending upward and in front of swing arm 50. Cable guide 54 includes through holes 56 for receipt of a cable and may include a sleeve to facilitate smooth sliding of the cable therein.

Now referring to pulley and cable system 36, this assembly includes a steel or otherwise suitably strong cable 60, at least three pulleys 62, and a tensioning weight 64. Two of the pulleys are pivotally connected to extension support arm 34 and the other pulley 62 is pivotally connected to upright support 32 towards a lower end thereof. One end of cable 60 is connected to the barbell of weights 16 with a loop or eye hook 66, which can include a quick release latch as is well known. The opposite end of cable 60 is attached to swing arm 50. The rest of the cable is threaded around pulleys 62 as shown in the figures, threaded through an eyelet 68 attached to tensioning weight 64, and through holes 56 in cable guide 54.

In operation, as should be appreciated tensioning weight 64 maintains tension on cable 60 through movement of the barbell of weights 16. Otherwise, the tension in cable 60 would change drastically from the weights 16 being supported on supports 24 and between when a user has their arms extended and bringing their arms down to do a bench press. It is important for tension to remain on the cable so that when a user needs assistance with lifting weights 16 back onto supports 24, the user 14, can push on foot pedal 38 thereby swinging swing arm 50 outward, which pulls on cable 60 and the end 66 connected to the barbell will assist in lifting the weight upward so that it can be placed safely on supports 24. It should further be appreciated that as user 14 extends their arms upward this effectively reduces the distance that cable 60 traverses, so that tensioning weight 64 sinks downward as the cable slides through eyelet 68. As user 14 lowers the dumbbell of weights 16 toward their chest, this increases the distance that cable 60 traverses so that tensioning weight rises and cable 60 slides on eyelet 68.

Additionally, user 14 can use the calf of the leg not pushing on pedal 38 to push back against leg leverage support 26 to prevent the user 14 from sliding back on bench support 22 instead of pushing the pedal outward.

Figure 9:
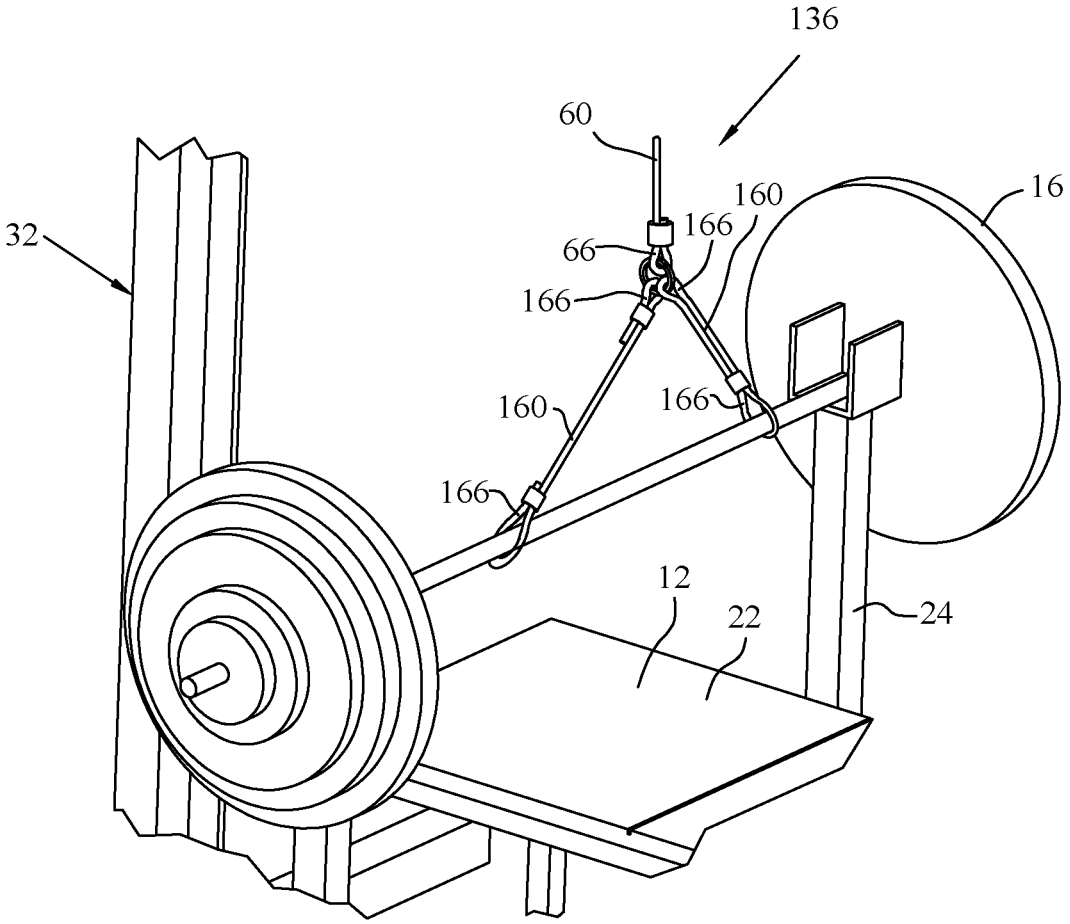
FIG. 9 is an alternate embodiment bar bell support for use on the self-spotting bench press of the subject invention.

Now referring to FIG. 9, an alternate embodiment pulley and cable system 136 is shown. Pulley and cable system 136, is the same in all respects as pulley and cable system 36, except that loop or eyehook 66 is not connected directly to the barbell of weights 16. Rather, it is connected to two short angled lengths of cable 160 to help offset imbalance as compared to a single cable slightly off center on the barbell. Cables 160 each include loops or eye hooks 166 on both ends thereof. One end is connected to loop 66 and the other end is connected to the barbell of weights 16.

Figure 10:
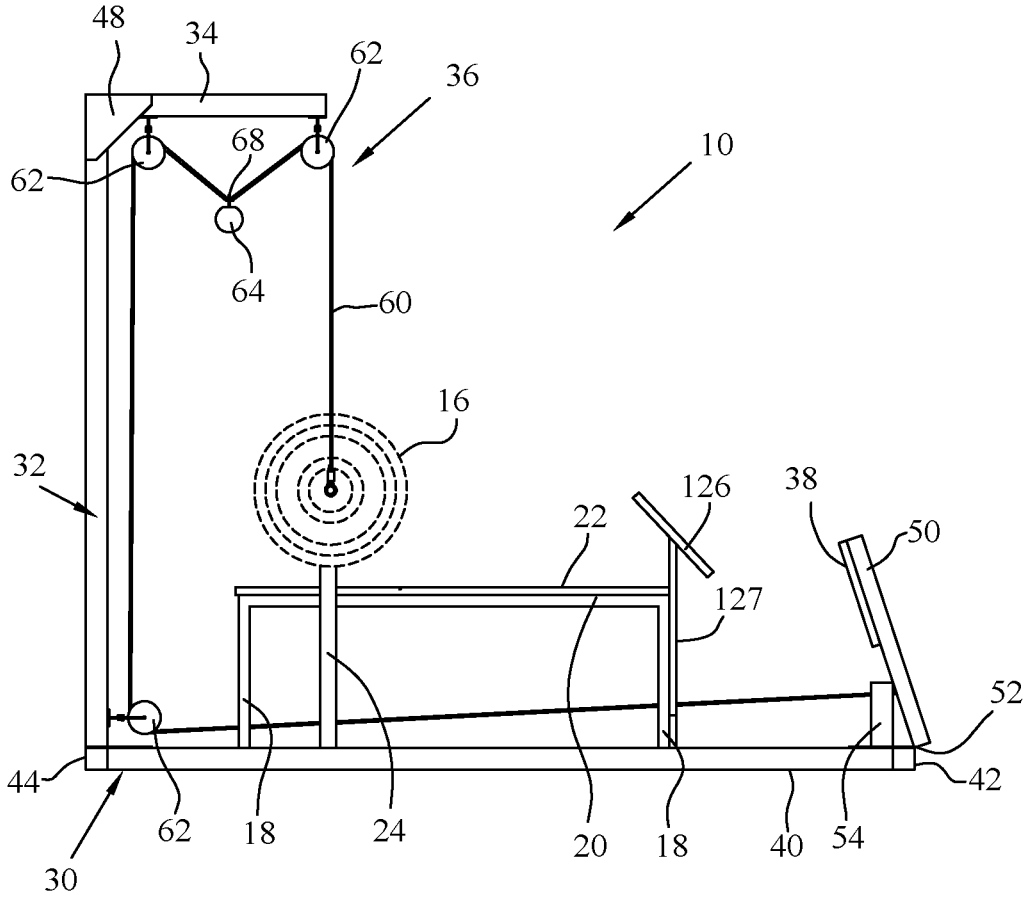
FIG. 10 shows an alternate embodiment leg leverage support.

Now referring to FIG. 10, an alternate leg leverage support 126 is shown. Leg leverage support 126 is mounted to a support member 127 and extends above user support surface 22. Additionally, leg leverage support 126 is mounted at an angle. Raising and angling leg leverage support 126 can make it easier for user 14 to hook with their leg that is not pushing on pedal 38 to provide a better leverage position for user 14 to push out pedal 38, thereby swinging out swing arm 50 to assist in lifting weights 16 up and onto supports 24.

While the invention has been taught with specific reference to these embodiments, one skilled in the art will recognize that changes can be made in form and detail without departing from the spirit and scope of the invention. For instance, although the embodiment shown and described above utilizes an optic sensor, the system may be used with other types of sensors for sensing when a syrup transmission line is empty. Therefore, the described embodiments are to be considered in all respects only as illustrative and not restrictive. As such, the scope of the invention is indicated by the following claims rather than by the description.

The invention claimed is:

1. A self-spotting bench press mechanism and system comprising:

a bottom support frame;

an upright support attached to said bottom support frame and extending upward;

an extension support arm attached to said upright support and configured to extend out over at least a portion of a weight bench located there beneath;

a foot pedal hingeably connected to said bottom support frame;

a cable configured to be connected to a barbell at one end thereof and connected to the foot pedal at the other end thereof;

at least three pulleys, with a first pulley of said at least three pulleys attached to said extension support arm and a second pulley of said at least three pulleys attached to said upright support, said cable supported on said at least three pulleys;

a third pulley of said at least three pulleys, said third pulley of said at least three pulleys attached to said extension support arm and said third pulley supporting said cable; and a tensioning mechanism to keep tension on said cable as the end of said cable configured to be connected to a barbell moves vertically up and down, said tensioning mechanism includes a weight freely suspended from said cable between said first and third pulleys of said at least three pulleys attached to said extension support arm and sliding on said cable when the cable moves.

2. The self-spotting bench press mechanism and system asset forth in claim 1, wherein said foot pedal is attached to a swing arm, the cable attached to said swing arm and said swing arm is hingeably connected to said bottom support frame.

3. The self-spotting bench press mechanism and system asset forth in claim 1, including a cable guide attached to said bottom support frame.

4. The self-spotting bench press mechanism and system as set forth in claim 3, wherein said cable guide includes a hole therethrough for receipt of said cable.

5. The self-spotting bench press mechanism and system as set forth in claim 1, wherein said system is configured so that when a user pushes on said foot pedal, the end of the cable configured to be connected to the barbell raises vertically upward.

6. A self-spotting bench press mechanism and system comprising:

a weight bench configured to support a user and a barbell with weights;

a bottom support frame;

an upright support attached said bottom support frame and extending upward;

an extension support arm attached to said upright support and configured to extend out over the barbell supported on said weight bench;

a foot pedal hingeably connected to said bottom frame support;

a cable configured to be connected to a barbell at one end thereof and connected to the foot pedal at the other end thereof;

a plurality of pulleys, with a first pulley of said plurality of pulleys attached to said extension support arm and a second pulley attached to said upright support, said cable supported on said plurality of pulleys;

a third pulley of said plurality of pulleys, said third pulley of said plurality of pulleys attached to said extension support arm and said third pulley of said plurality of pulleys supporting said cable; and a tensioning mechanism to keep tension on the cable as the end of the cable configured to be connected to a barbell moves vertically up and down, said tensioning mechanism includes a weight freely suspended from said cable between said first and third pulleys of said plurality of pulleys attached to said extension support arm and sliding on said cable when the cable moves.

7. The self-spotting bench press mechanism and system as set forth in claim 6, wherein said foot pedal is attached to a swing arm, the cable attached to said swing arm and said swing arm is hingeably connected to said bottom support frame.

8. The self-spotting bench press mechanism and system as set forth in claim 7, including a leg leverage support configured to allow a user to gain leverage by pulling on said leg leverage support with one leg while using the other leg to push the foot pedal forward.

9. The self-spotting bench press mechanism and system asset forth in claim 8, wherein said leg leverage support is attached to said weight bench.

10. The self-spotting bench press mechanism and system asset forth in claim 9, wherein said leg leverage support extends above a surface of said weight bench configured to support the user.

11. A self-spotting bench press mechanism and system comprising: a bottom support frame;

an upright support attached said bottom support frame and extending upward;

an extension support arm attached to said upright support and configured to extend out over at least a portion of a weight bench located there beneath;

a foot pedal hingeably connected to said bottom support frame;

a cable configured to be connected to a barbell at one end thereof and connected to the foot pedal at the other end thereof;

a plurality of pulleys, with at least two pulleys attached to said extension support arm, said cable supported on said plurality of pulleys; and a tensioning mechanism to keep tension on the cable as the end of the cable configured to be connected to a barbell moves vertically up and down, said tensioning mechanism includes a weight freely suspended from said cable between said at least two pulleys attached to said extension support arm and sliding on said cable when the cable moves.

12. The self-spotting bench press mechanism and system as set forth in claim 11, including a leg leverage support configured to allow a user to gain leverage by pulling on said leg leverage support with one leg while using the other leg to push the foot pedal forward.

13. The self-spotting bench press mechanism and system asset forth in claim 12, wherein said leg, leverage support extends above a surface of said weight bench configured to support the user.

14. The self-spotting bench press mechanism and system as set forth in claim 13, wherein said leg leverage support is mounted at an angle to a vertical.

15. The self-spotting bench press mechanism and system as set forth in claim 11, wherein said cable includes more than one connection point where configured to be connected to the barbell.

* * * * *